US008711087B2

(12) United States Patent
Takei et al.

(10) Patent No.: US 8,711,087 B2
(45) Date of Patent: Apr. 29, 2014

(54) METHOD FOR DRIVING ELECTROPHORETIC DISPLAY DEVICE, ELECTROPHORETIC DISPLAY DEVICE, AND ELECTRONIC DEVICE

(75) Inventors: Yoshiki Takei, Matsumoto (JP); Eiji Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 943 days.

(21) Appl. No.: 12/692,791

(22) Filed: Jan. 25, 2010

(65) Prior Publication Data

US 2010/0201677 A1 Aug. 12, 2010

(30) Foreign Application Priority Data

Feb. 6, 2009 (JP) ..... 2009-026393
Aug. 3, 2009 (JP) ..... 2009-180602

(51) Int. Cl.
*G09G 3/34* (2006.01)

(52) U.S. Cl.
USPC ..... 345/107; 345/101; 345/211; 345/212; 345/213; 345/214

(58) Field of Classification Search
USPC ..... 345/101, 107, 211–214
See application file for complete search history.

(56) References Cited

U.S. PATENT DOCUMENTS

2003/0067666 A1 4/2003 Kawai
2006/0092124 A1 5/2006 Zhou et al.
2007/0075962 A1* 4/2007 Zhou et al. ..... 345/107
2008/0100566 A1* 5/2008 Miyasaka et al. ..... 345/107
2008/0238867 A1 10/2008 Maeda et al.
2008/0277279 A1* 11/2008 Hirayama et al. ..... 204/406
2009/0058798 A1 3/2009 Miyazaki

FOREIGN PATENT DOCUMENTS

| | | | |
|---|---|---|---|
| JP | 52-70791 | | 6/1977 |
| JP | 2003-140199 | | 5/2003 |
| JP | 2007-501436 | | 1/2007 |
| JP | 2007-187936 | | 7/2007 |
| JP | 2007-187938 | | 7/2007 |
| JP | 2008-139739 | A | 6/2008 |
| JP | 2008-164862 | A | 7/2008 |
| JP | 2008-268853 | | 11/2008 |
| JP | 2009-20285 | | 1/2009 |
| JP | 2009-58801 | | 3/2009 |
| WO | WO2004-104977 | | 12/2004 |

* cited by examiner

*Primary Examiner* — William Boddie
*Assistant Examiner* — Saifeldin Elnafia
(74) *Attorney, Agent, or Firm* — Harness, Dickey & Pierce, P.L.C.

(57) ABSTRACT

A method for driving an electrophoretic display device, which includes a first electrode, a second electrode, and an electrophoretic element disposed between the first electrode and the second electrode, the method includes: setting a multiplication of a driving voltage and a voltage application time of the electrophoretic element in a unit period, which displays a first gradation with minimum reflectivity, and a multiplication of a driving voltage and a voltage application time of the electrophoretic element in the unit period, which displays a second gradation with maximum reflectivity, so as to be different from each other.

16 Claims, 14 Drawing Sheets

FIG. 7A
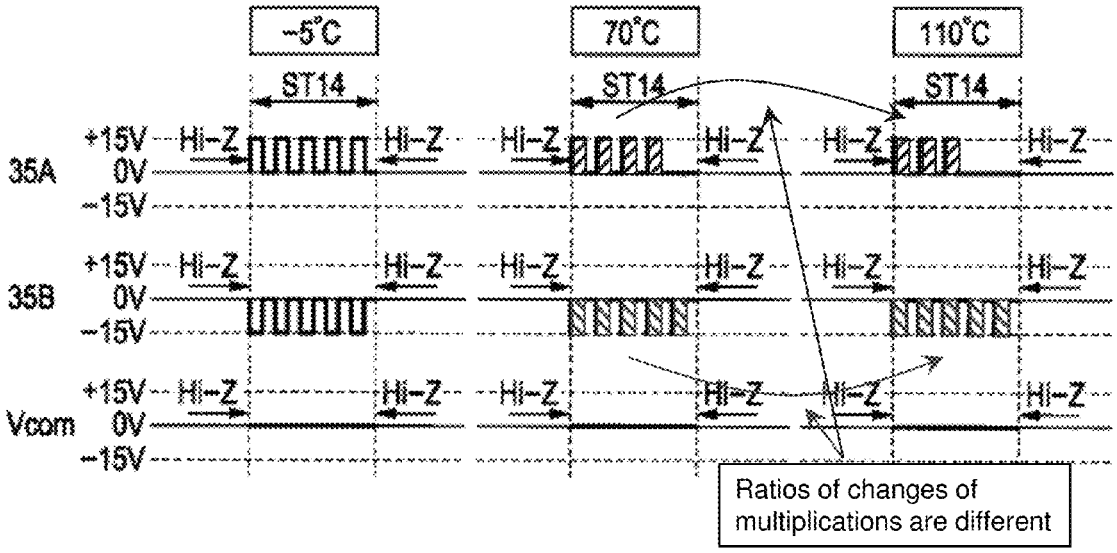
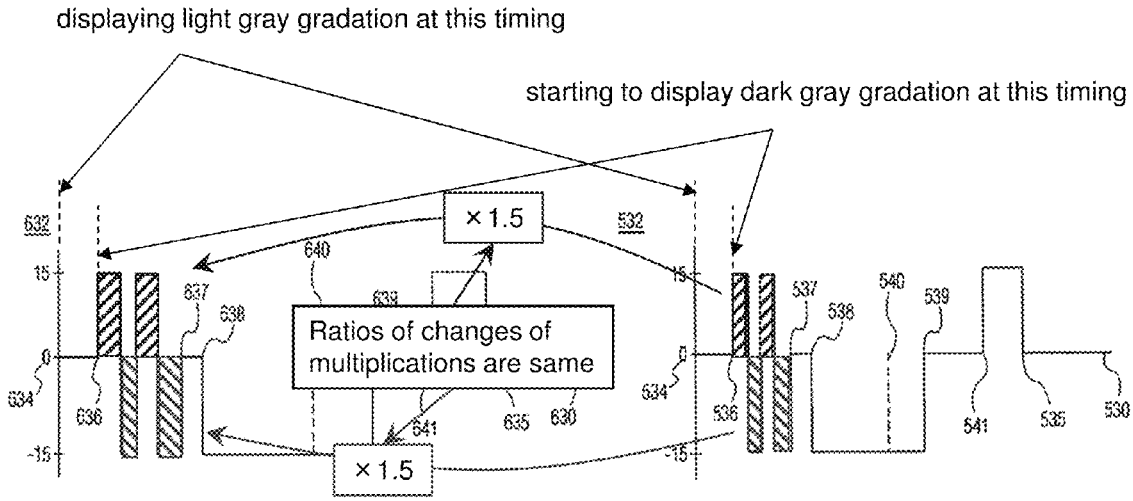
FIG. 6 20 °C
FIG. 5 25 °C

LEAK POWER AT WHITE AND BLACK DISPLAY ACCORDING TO TEMPERATURE (15 V, 0.5 s)

LEAK POWER AT WHITE AND BLACK DISPLAY ACCORDING TO TEMPERATURE

LEAK POWER AT WHITE AND BLACK DISPLAY ACCORDING TO TEMPERATURE

METHOD FOR DRIVING ELECTROPHORETIC DISPLAY DEVICE, ELECTROPHORETIC DISPLAY DEVICE, AND ELECTRONIC DEVICE

BACKGROUND

1. Technical Field

The present invention relates to a method for driving an electrophoretic display device, an electrophoretic display device, and an electronic device.

2. Related Art

There is known a type of an electrophoretic display device, in which an electrophoretic element, which includes electrophoretic particles and a dispersion medium, is interposed in a space defined between a pair of substrates. In this type of an electrophoretic display device, the mobility of the electrophoretic particles depends on temperature. Accordingly, the extensible application time of a driving voltage for the electrophoretic element is prolonged in a low-temperature environment (refer to, for example, JP-T-2007-501436) or an operation of repeatedly writing at every specific period is performed in order to ensure performance that stores and maintains a display (refer to, for example, JP-A-2007-187936 and JP-A-2007-187938).

According to approaches disclosed in JP-T-2007-501436 as well as JP-A-2007-187936 and JP-A-2007-187938, it is possible to compensate for a variation in the mobility of charged particles that is caused by a change in temperature. However, through studies conducted by the inventor et al., it was newly found that current balance is sometimes completely broken due to a great difference in the value of a current between white display and black display when the temperature of an application environment changes.

FIG. 9 is a graph showing the relationship between environment temperature and leak power. FIGS. 10A to 10C are graphs showing the results by measuring the values of the leak currents of white display and black display at environmental temperatures −5° C., 70° C., 110° C., respectively. The graph shown in FIG. 9 is produced by plotting the integrated values of the leak currents (i.e., leak powers) of the respective graphs in FIGS. 10A to 10C with respective to the respective environmental temperatures. As shown in FIG. 9, the difference between the leak power of white display and the leak power of black display increases with the rise in environmental temperature.

As such, if the current balance between white display and black display is broken, a large amount of current flows in a specific direction into an electrophoretic element or an electrode, so that the electrophoretic element or the electrode is vulnerable to degradation. In the examples shown in FIGS. 9 and 10A to 10C, a large amount of current flows from an Indium-Tin-Oxide (ITO) electrode, located over a display surface, toward an electrode over the opposite surface of an electrophoretic display device. In addition, degradation occurs due to reduction by the current. For example, impurity components are stuck to the ITO electrode, thereby coloring it. Such a problem may occur in the electrophoretic display device that has an electrode made of ITO or the like, which can be easily reduced. Furthermore, the problem may occur not only when the leak power of black display is relatively large but also when the leak power of white display is relatively large.

SUMMARY

An advantage of some aspects of the invention is to provide a method for driving an electrophoretic display device, which can prevent electrodes from degrading, and such an electrophoretic display device.

In a method for driving an electrophoretic display device according to the invention, the electrophoretic display device includes an electrophoretic element interposed between a pair of substrates, a first electrode formed on a portion of one of the substrates adjacent to the electrophoretic element, and a second electrode formed on a portion of the other one of the substrates adjacent to the electrophoretic element. The driving method includes setting leak power in a unit period, which displays a first gradation with minimum reflectivity, and leak power in the unit period, which displays a second gradation with maximum reflectivity, so as to be substantially equal to each other by adjusting the leak powers using one or more of a driving voltage and a voltage application time of the electrophoretic element in the unit period.

According to this driving method, it is possible to prevent a large amount of current from flowing in one direction between the first and second electrodes by adjusting the leak powers so as to be substantially the same using one or more of the driving voltage and the voltage application time of the electrophoretic element. This, as a result, makes it possible to prevent the electrodes from degrading that would otherwise be accelerated by a change in temperature.

It is preferable that the driving voltage and the voltage application time may be set based on environmental temperature.

According to the driving method as above, it is possible more effectively to prevent the electrodes from degrading by reliably removing the difference between the leak powers, which vary according to a change in the environmental temperature.

It is preferable that the driving voltage and the voltage application time may be set based on the value of the leak current between the first electrode and the second electrode.

According to the driving method as above, it is possible effectively to prevent the electrodes from degrading since the leak power can be directly adjusted based on the value of the leak current.

In a method for driving an electrophoretic display device according to the invention, the electrophoretic display device includes an electrophoretic element interposed between a pair of substrates, a plurality of first electrodes formed on a portion of one of the substrates adjacent to the electrophoretic element, and a second electrode formed on a portion of the other one of the substrates adjacent to the electrophoretic element, opposite the first electrodes, the second electrode made of a transparent conductive material. The driving method includes setting leak powers in a unit period, which displays a first gradation with minimum reflectivity or a second gradation with maximum reflectivity, so that the leak power, which leaks when the potential of the second electrode is higher than that of the first electrode, exceeds the leak power, which leaks when the potential of the first electrode is higher than that of the second electrode.

According to the driving method as above, it is possible to suppress reduction in the second electrode made of a transparent conductive material. This also makes it possible to prevent the second electrode from degrading. In addition, the driving method can be realized using a simple configuration since it is not necessary to vary the driving voltage or the voltage application time in response to the passage of time.

It is preferable that first input power, which is input into the electrophoretic element when the potential of the second electrode is higher than that of the first electrode, may exceed second input power, which is input into the electrophoretic element when the potential of the first electrode is higher than that of the second electrode, and wherein the first input power has a constant ratio with respect to the second input power.

According to the driving method as above, it is possible to prevent the second electrode from degrading by performing only a simple manipulation to set the ratio of the input powers.

It is preferable that the constant ratio may be set so that the leak power when the potential of the second electrode is higher than that of the first electrode and the leak power when the potential of the second electrode is higher than that of the first electrode are equal to each other.

According to the driving method as above, it is possible to prevent the second electrode from degrading in a temperature range equal to or lower than a preset environmental temperature.

It is preferable that the leak powers may have a relationship that is set in an application temperature range of the electrophoretic display device.

According to the driving method as above, it is possible to prevent the second electrode from degrading over the entire range of environmental temperatures to be used.

In a method for driving an electrophoretic display device according to the invention, the electrophoretic display device includes an electrophoretic element interposed between a pair of substrates, a first electrode formed on a portion of one of the substrates adjacent to the electrophoretic element, and a second electrode formed on a portion of the other one of the substrates adjacent to the electrophoretic element. The driving method includes setting a multiplication of a driving voltage and a voltage application time of the electrophoretic element in a unit period, which displays a first gradation with minimum reflectivity, and a multiplication of a driving voltage and a voltage application time of the electrophoretic element in the unit period, which displays a second gradation with maximum reflectivity, so as to be different from each other.

As such, it is possible to set the leak power when the first gradation is displayed and the leak power when the second gradation is displayed so as to be the same by setting the multiplication of a driving voltage and a voltage application time when the first gradation is displayed so as to be different from that when the second gradation is displayed. This, as a result, makes it possible to prevent the electrodes from degrading.

An electrophoretic display device according to the invention includes an electrophoretic element interposed between a pair of substrates; a first electrode formed on a portion of one of the substrates adjacent to the electrophoretic element; a second electrode formed on a portion of the other one of the substrates adjacent to the electrophoretic element; and a controller adjusting leak power in a unit period, which displays a first gradation with minimum reflectivity, and leak power in the unit period, which displays a second gradation with maximum reflectivity, so as to be substantially equal to each other by adjusting the leak powers using one or more of a driving voltage and a voltage application time of the electrophoretic element.

According to this configuration, the electrophoretic display device can prevent the electrode from degrading by preventing a large amount of current from flowing in one direction between the first and second electrodes by controlling the leak powers so as to be substantially the same using the controller.

It is preferable that the electrophoretic display device may further include a temperature detector detecting environmental temperature; and a calculator or table relating one or more of a driving voltage and a voltage application time of the electrophoretic element to the environmental temperature.

According to this configuration, it is possible more effectively to prevent the electrodes from degrading by reliably removing the difference between the leak powers, which vary according to a change in the environmental temperature.

It is preferable that the electrophoretic display device may further include a current measurer measuring the value of a leak current flowing between the first and second electrodes; and a calculator or table relating one or more of a driving voltage and a voltage application time of the electrophoretic element to the value of the leak current.

According to this configuration, it is possible effectively to prevent the electrodes from degrading since the leak power can be directly adjusted based on the value of the leak current.

An electrophoretic display device according to the invention includes an electrophoretic element interposed between a pair of substrates; a plurality of first electrodes formed on a portion of one of the substrates adjacent to the electrophoretic element; and a second electrode formed on a portion of the other one of the substrates adjacent to the electrophoretic element, opposite the first electrodes, the second electrode made of a transparent conductive material. Leak powers in a unit period, which displays a first gradation with minimum reflectivity or a second gradation with maximum reflectivity, may be set so that the leak power, which leaks when the potential of the second electrode is higher than that of the first electrode, exceeds the leak power, which leaks when the potential of the first electrode is higher than that of the second electrode.

According to this configuration, it is possible to suppress reduction in the second electrode made of a transparent conductive material. This also makes it possible to prevent the second electrode from degrading. In addition, the electrophoretic display device can be realized using a simple configuration and thus be provided at an inexpensive price since it is not necessary to vary the driving voltage or the voltage application time in response to the passage of time.

An electrophoretic display device according to the invention includes an electrophoretic element interposed between a pair of substrates; a first electrode formed on a portion of one of the substrates adjacent to the electrophoretic element; and a second electrode formed on a portion of the other one of the substrates adjacent to the electrophoretic element. A multiplication of a driving voltage and a voltage application time of the electrophoretic element in a unit period, which displays a first gradation with minimum reflectivity, may be set differently from a multiplication of a driving voltage and a voltage application time of the electrophoretic element in the unit period, which displays a second gradation with maximum reflectivity.

According to this configuration, it is possible to set the leak power when the first gradation is displayed and the leak power when the second gradation is displayed so as to be the same by setting the multiplication of a driving voltage and a voltage application time when the first gradation is displayed so as to be different from that when the second gradation is displayed. This, as a result, makes it possible to prevent the electrodes from degrading.

An electronic device according to the invention includes the electrophoretic display device as described above.

According to this configuration, it is possible to provide an electronic device having a high-reliability display section.

BRIEF DESCRIPTION OF THE DRAWINGS

The invention will be described with reference to the accompanying drawings, wherein like numbers reference like elements.

FIG. 5 is a flowchart showing a driving method according to an exemplary embodiment of the invention.

FIG. 6 is an explanatory view showing the transition state of pixels by the driving method according to an exemplary embodiment of the invention.

FIGS. 7A and 7B are views showing examples of drive waveforms.

DESCRIPTION OF EXEMPLARY EMBODIMENTS

Figure 1:
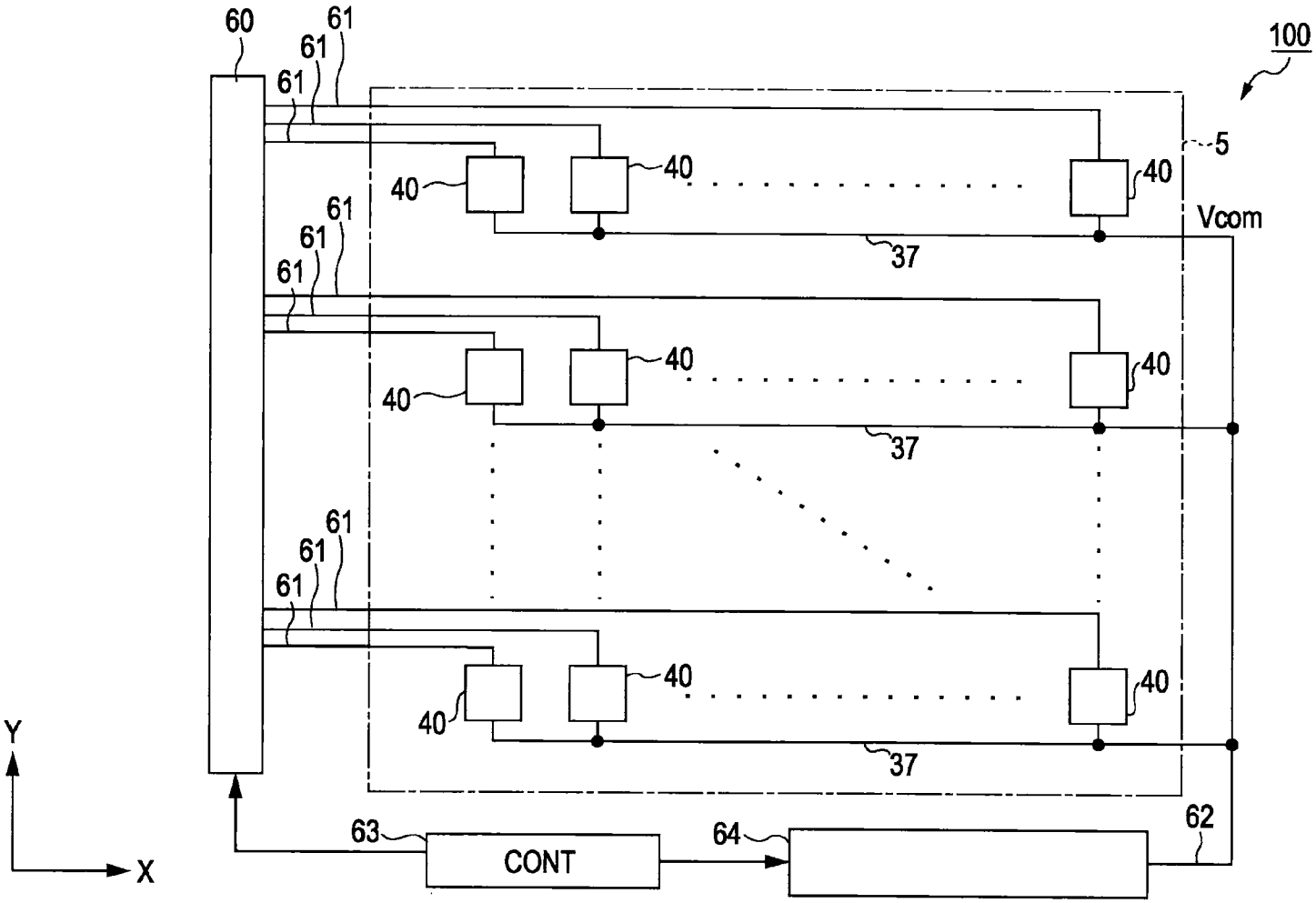
FIG. 1 is a schematic configuration view of an electrophoretic display device according to an exemplary embodiment of the invention.

Hereinafter, an electrophoretic display device and a method for driving the same according to exemplary embodiments of the invention will be described with reference to the accompanying drawings.

The scope of the invention is not limited to the following exemplary embodiments, which can be appropriately modified without departing from the range of the technical idea of the invention. In the drawings below, scales, numbers, or the like of structures are different from actual structures so that each constitution can be easily recognized.

Figure 2A:
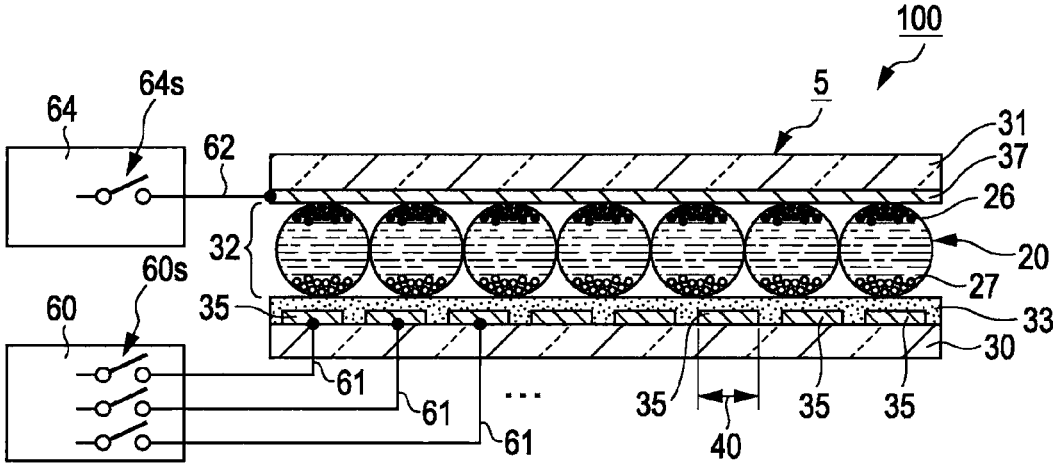
FIGS. 2A and 2B are views showing the cross-sectional structure of important parts of the electrophoretic display device according to an exemplary embodiment of the invention.

FIG. 1 is a schematic configuration view of an electrophoretic display device 100 according to an exemplary embodiment of the invention. FIG. 2A is a view showing the cross-sectional structure as well as the electrical structure of the electrophoretic display device 100.

The electrophoretic display device 100 includes a display section 5, in which a plurality of pixels (i.e., segments) 40 are disposed, a controller 63 (i.e., a control section), and a pixel electrode driving circuit 60 connected to the controller 63. The pixel electrode driving circuit 60 is connected to the pixels 40 via pixel electrode lines 61, respectively. In addition, the display section 5 is provided with a common electrode 37 (see FIG. 2) that is common to the pixels 40. For the sake of convenience, the common electrode 37 is shown as lines in FIG. 1.

The electrophoretic display device 100 is a segment-driving type electrophoretic display device that directly inputs a potential based on image data into each pixel 40 by sending the image data from the controller 63 to the pixel electrode driving circuit 60.

As shown in FIG. 2A, the display section 5 of the electrophoretic display device 100 is configured such that an electrophoretic element 32 is interposed between first and second substrates 30 and 31. A plurality of pixel electrodes (i.e., segment electrodes or first electrodes) 35 are formed on portions of the first substrate 30 adjacent to the electrophoretic element 32, and a common electrode (i.e., second electrode) 37 is formed on a portion of the second substrate 31 adjacent to the electrophoretic element 32. The electrophoretic element 32 is configured such that a plurality of microcapsules 20 is arrayed on a plane. Each of the microcapsules 20 encapsulates electrophoretic particles therein. The electrophoretic display device 100 displays an image, generated by the electrophoretic element 32, on a portion adjacent to the common electrode 37.

The first substrate 30 is a substrate made of glass, plastic, or the like, and may not be transparent since it is disposed opposite the surface on which an image is displayed. The pixel electrodes 35 are formed by sequentially stacking a Ni plating layer and an Au plating layer on a Cu film, or using Al, Indium-Tin-Oxide (ITO), or the like.

Meanwhile, the second substrate 31 is a substrate made of glass, plastic, or the like, and is a transparent substrate since it is disposed on the side where an image is displayed. The common electrode 37 is a transparent electrode formed using MgAg, ITO, IZO (Registered trademark; Indium-Zinc-Oxide), or the like.

Each of the pixel electrodes 35 is connected to the pixel electrode driving circuit 60 via one of the pixel electrode lines 61. The pixel electrode driving circuit 60 is provided with switching elements 60*s*, which correspond to the pixel electrode lines 61, respectively. The operation of the switching elements 60*s* allows the inputting of a potential into, and to electrically disconnect (i.e., provide high impedance to), the pixel electrodes 35.

In addition, a common electrode driving circuit 64 is connected to the common electrode 37 via a common electrode line 62. The common electrode driving circuit 64 is provided with a switching element 64*s* connected to the common electrode line 62. The operation of the switching element 64*s* allows the inputting of a potential into, and to electrically disconnect (i.e., provide high impedance to), the common electrode 37.

In general, the electrophoretic element 32 is treated as an electrophoretic sheet, which is formed over one side of the second substrate 31 in advance and also includes an adhesive layer 33. In a fabrication process, the electrophoretic sheet is treated in the state where a protective peel sheet is attached to the surface of the adhesive layer 33. In addition, the display section 5 is formed by attaching the electrophoretic sheet, from which the peel sheet is taken off, onto the separately-manufactured first substrate 30 (on which the pixel electrodes 35 and the like are formed). As a result, the adhesive layer 33 is present only over the pixel electrodes 35.

Figure 2B:
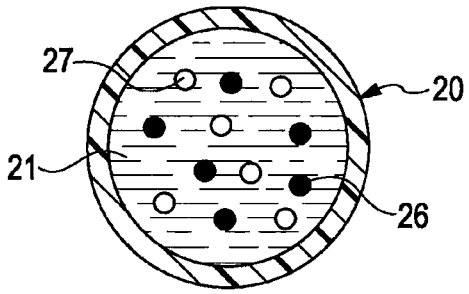

FIG. 2B is a schematic cross-sectional view of a microcapsule 20. The microcapsule 20 is a spheroid with a particle size of, for example, 30 to 50 μm, inside of which dispersion medium 21, a plurality of white particles (i.e., electrophoretic particles) 27, and a plurality of black particles (i.e., electrophoretic particle) 26 are encapsulated. As shown in FIG. 2A, one or more microcapsules 20 are disposed in one pixel 40, interposed between the common electrode 37 and the pixel electrode 35.

The outer shell (i.e., wall film) of the microcapsule 20 is made of an acrylic resin such as polymethylmethacrylate and polyethylmethacrylate, a urea resin, a transparent polymer resin such as Arabic gum, or the like.

The dispersion medium 21 is a liquid that disperses the white particles 27 and the black particles 26 in the microcapsule 20. Examples of the dispersion medium 21 may include water, alcoholic solvents (methanol, ethanol, isopropanol, buthanol, octanol, methyl cellosolve, and the like), esters (ethyl acetate, methyl acetate, and the like), ketones (acetone, methyl ethyl ketone, methyl isobuthyl ketone, and the like), aliphatic hydrocarbons (pentane, hexane, octane, and the like), alicyclic hydrocarbons (cyclohexane, methyl cyclohexane, and the like), aromatic hydrocarbons (bezene, toluene, bezens having a long-chained alkyl group (xylene, hexylbenzene, heptylbenzene, nonylbenzene, decylbenzene, undecylbenzene, dodecylbenzene, tridecylbenzene, tetradecylbenzene, and the like), and the like), halogenated hydrocarbons (methylene chloride, chloroform, carbon tetrachloride, 1,2-dichloroethane, and the like), carbonates, and the like. The dispersion medium 21 can be other kinds of oil. These materials can be used alone or in mixtures, and surfactant can be additionally mixed.

The white particles 27 are particles made of, for example, white pigment such as titan dioxide, zinc white, and antimony trioxide (polymer or colloid), and are used, for example, in a negatively-charged state. The black particles 26 are particles made of, for example, aniline black, carbon black, or the like (polymer or colloid), and are used, for example, in a positively-charged state.

If necessary, it is possible to add a charge-controlling agent composed of particles such as electrolyte, surfactant, metal soap, resin, rubber, oil, varnish, compound, and the like; a dispersing agent such as a titanium-based coupling agent, an aluminum-based coupling agent, silane-based coupling agent, or the like; a lubricant; a stabilizer; or the like into such a pigment.

In substitution of the black particles 26 and the white particles 27, pigments having other colors, for example, red, green, blue, or the like can be used. Due to this configuration, the display section 5 can have red, green, blue, and the like.

Figure 3A:
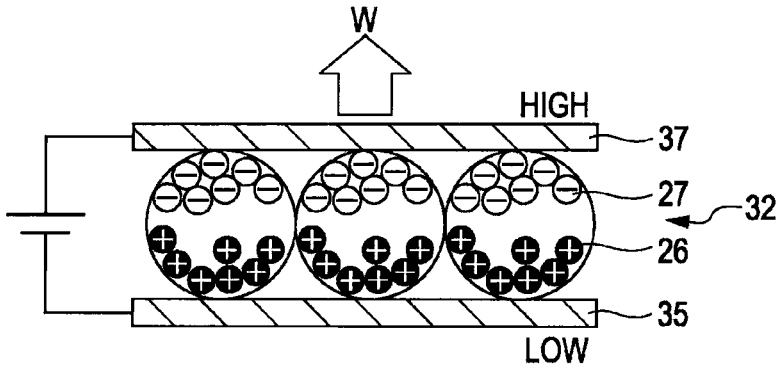
FIGS. 3A and 3B are explanatory views of the operation of the electrophoretic display device.
Figure 3B:
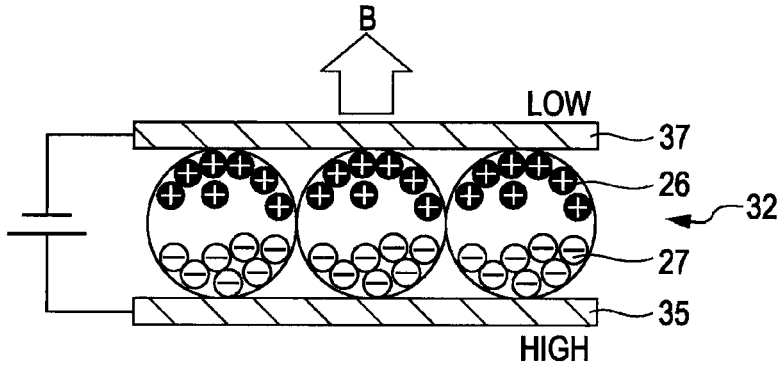

FIGS. 3A and 3B are explanatory views of the operation of the electrophoretic display device. FIG. 3A illustrates a case where the pixel 40 is displayed white, and FIG. 3B illustrates a case where the pixel 40 is displayed black.

In the case of white display shown in FIG. 3A, the common electrode 37 is maintained at a relatively-high potential, whereas the pixel electrode 35 is maintained at a relatively-low potential. Accordingly, the common electrode 37 attracts the white particles 27, which are negatively charged, and the pixel electrode 35 attracts the black particles 26, which are positively charged. As a result, white (W) is recognized when the pixel is viewed from the side of the common electrode 37, which is the display surface side.

In the case of black display shown in FIG. 3B, the common electrode 37 is maintained at a relatively-low potential, whereas the pixel electrode 35 is maintained at a relatively-high potential. Accordingly, the common electrode 37 attracts the black particles 26, which are positively charged, and the pixel electrode 37 attracts the white particles 27, which are negatively charged. As a result, black (B) is recognized when the pixel is viewed from the side of the common electrode 37.

Figure 4:
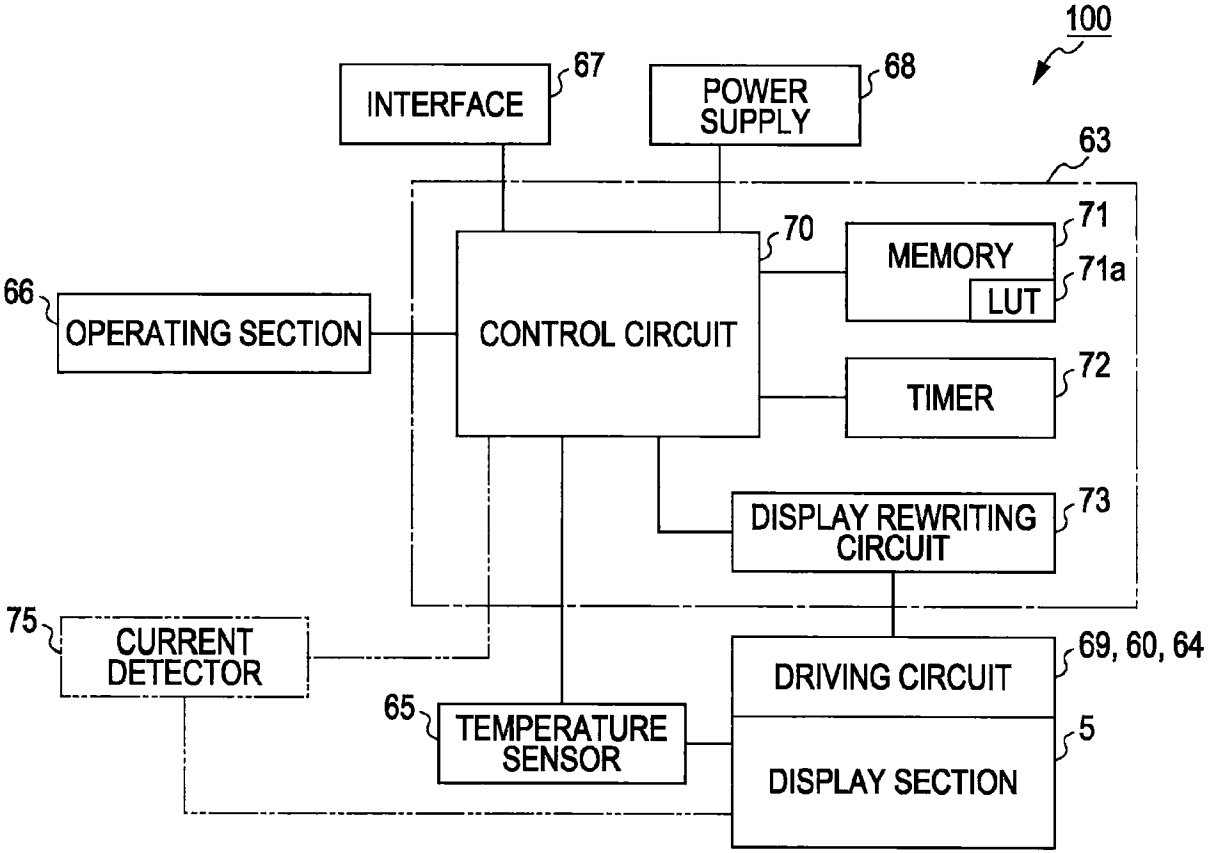
FIG. 4 is a block diagram of the electrophoretic display device according to an exemplary embodiment of the invention.

FIG. 4 is a functional block diagram of the electrophoretic display device 100.

As shown in FIG. 4, the electrophoretic display device 100 includes a controller 63, a temperature sensor 65, an operating section 66, an interface 67, a power supply 68, and a driving circuit 69. The driving circuit 69 includes the pixel electrode driving circuit 60 and the common electrode driving circuit 64 shown in FIGS. 1 and 2A, and is connected to a display section 5.

The controller 63 includes a control circuit 70, a memory 71 (i.e., a storage section), a timer 72, and a display rewriting circuit 73.

The control circuit 70 is a Central Processing Unit (CPU) of the electrophoretic display device 100, and performs overall control over respective components of the electrophoretic display device 100. Inside the controller 63, the control circuit 70 is connected to the memory 71, the timer 72, and the display rewriting circuit 73. In addition, the control circuit 70 is connected with the temperature sensor 65 (i.e., a temperature detector), the operating section 66, the interface 67, and the power supply 68, which are provided outside the controller 63.

The memory 71 can be a volatile or nonvolatile memory. Available examples of the volatile memory may include Static Random Access Memory (SRAM), Dynamic Random Access Memory (DRAM), and the like. Available examples of the nonvolatile memory may include Read Only Memory (ROM), Programmable ROM (PROM), flash memory, Ferroelectric Random Access Memory (FeRAM), and the like.

The memory 71 stores a Lookup Table (LUT) 71*a* that specifies the correlation between temperature information and the drive waveform of the electrophoretic element 32. The memory 71 can also store specific image data that define display image patterns at the event of powering on/off, a program controlling the driving of the display section 5, and the like. In addition, the memory 71 can function as a working memory that maintains temperature information or operating time information, which is acquired using the temperature sensor 65.

The timer 72 performs intended time measurement independently or under the control of the control circuit 70. The configuration of the timer 72 is not specifically limited. The timer 72 can be mounted inside the controller 63 or be separately mounted as an independent device like the temperature sensor 65.

The display rewriting circuit 73 converts image data, which is input into the control circuit 70 via the interface 67 and is then sent from the control circuit 70, into image data that can be displayed on the pixel 40 of the display section 5. In the display rewriting circuit 73, the converted image data includes display color information corresponding to each pixel 40. The image data generated by the display rewriting circuit 73 is sent to the driving circuit 69 (the pixel electrode driving circuit 60 and the common electrode driving circuit 64).

The temperature sensor 65 is a sensor of which electrical quantities such as resistance and capacitance vary with temperature, and sends a detected temperature to the control circuit 70. Available examples of the temperature sensor 65 may include a thermistor, a thermocouple, and the like. Since a signal, input into the control circuit 70 from the temperature sensor 65, is an analog detection signal, it is preferred that an Analog-Digital (AD) converter, which AD-converts the analog detection signal into data as coded temperature information, be installed inside the controller 63 or the control circuit 70.

One or more temperature sensors 65 are provided in the electrophoretic display device 100, in positions where they can measure the temperature of the display section 5 shown in FIGS. 1 and 2A.

For example, the temperature sensor 65 can be mounted on the rear side of the first substrate 30 shown in FIG. 2A. The temperature sensors 65 can be mounted on two or more positions such as surroundings of the central portion and the circumference of the display section 5 if the display section 5 has a large planar area. In the case where a plurality of temperature sensors 65 are mounted, temperature information acquired in the control circuit 70 can be the simple average, the weighted average, or the maximum of a plurality of temperatures, measured by the temperature sensors 65.

The operating section 66 is a user interface of the electrophoretic display device 100 into which operation instructions from a user are input.

The interface 67 is a device that connects the electrophoretic display device 100 to an external device (not shown). The interface 67 sends image data or a command, input from the external device, into the control circuit 70 while sending a response signal or the like, output from the control circuit 70, to the external device.

The power supply 68 is a battery, which supplies electric power to the electrophoretic display device 100, or a power supply circuit, which is connected to an external power supply.

The driving circuit 69 inputs an image signal to each pixel 40 based on image data input from the display rewriting circuit 73. As a result, the electrophoretic element 32 of each pixel 40 is driven, thereby displaying an image specified in the image data on the display section 5.

Driving Method

Below, a description will be given of a method for driving the electrophoretic display device configured as above.

FIG. 5 is a flowchart showing a method for driving the electrophoretic display device. As shown in FIG. 5, the driving method of this embodiment has image-displaying step ST1, which includes temperature-detecting step ST11, setting information-acquiring step ST12, drive waveform-setting step ST13, and display section-driving step ST14.

First, in the temperature-detecting step ST11, the control circuit 70 acquires temperature information from an output of the temperature sensor 65, and maintains the temperature information as a present environmental temperature (i.e., the temperature of the display section 5). The temperature information can be stored in a memory area (not shown) for environmental temperatures, which is provided in the memory 71. Afterwards, the process proceeds to the setting information-acquiring step ST12.

In the setting information-acquiring step ST12, the control circuit 70 refers to the LUT 71*a* stored in the memory 71, based on the temperature information acquired in the temperature-detecting step ST11. The control circuit 70 acquires the setting information of drive waveforms according to environmental temperatures from the LUT 71*a*. The setting information of drive waveforms is set or corrected values of driving voltage or voltage application time, and specifically, includes pulse width, the number of pulses, duty ratio, pulse height (voltage amplitude), and the like.

The LUT 71*a* of the memory 71 maintains a table relating temperature information on environmental temperature to the setting information, which determines a waveform to be input into the pixel electrode 35 when the pixel 40 is driven.

As described above with reference to FIG. 9, if environmental temperature is high, a difference occurs between the leak power of white display and the leak power of black display. The difference increases as the environmental temperature rises. The LUT 71*a* specifies the setting information of drive waveforms for solving the difference of the leak powers.

The leak power is produced by integrating a leak current at a voltage application time with respect to the electrophoretic element 32. The leak power increases with the leak current or voltage application time increasing. In addition, in the graph shown in FIG. 9, the leak power of black display increases with the environmental temperature rising.

Accordingly, in this embodiment, the setting information of drive waveforms (i.e., set or corrected values of driving voltage or voltage application time), which is for increasing the leak power of white display or reducing the leak power of black display as the environmental temperature rises, is specified in the LUT 71*a*.

More detailed configurations of the LUG 71*a* are illustrated, by way of examples, in the following configurations 1 to 5.

Configuration 1: This configuration specifies the relationship between environmental temperature and the number of pulses in such a manner that the difference between the number of pulses input into the pixel electrode 35 in white display and the number of pulses input into the pixel electrode 35 in black display increases as the environmental temperature rises (see FIG. 7A).

Configuration 2: This configuration specifies the relationship between environmental temperature and pulse width in such a manner that the difference between the pulse width input into the pixel electrode 35 in white display and the pulse width input into the pixel electrode 35 in black display increases as the environmental temperature rises (see FIG. 7B).

Configuration 3: This configuration specifies the relationship between environmental temperature and duty ratio in such a manner that the difference between the duty ratio of pulses input into the pixel electrode 35 in white display and the duty ratio of pulses input into the pixel electrode 35 in black display increases as the environmental temperature rises (see FIG. 8A).

Configuration 4: This configuration specifies the relationship between environmental temperature and pulse height in such a manner that the difference between the pulse height input into the pixel electrode 35 in white display and the pulse height input into the pixel electrode 35 in black display increases as the environmental temperature rises (see FIG. 8B).

Configuration 5: This configuration specifies the relationship of a set or corrected value, produced by combining two or more parameters of the above-described number of pulses, pulse width, duty ratio, and pulse height, with respect to environmental temperature.

Afterwards, the process proceeds to the drive waveform-setting step ST13. Then, the control circuit 70 sets the pulse width, the number of pulses, the duty ratio, the pulse height, and the like of a drive waveform, which is to be input into the pixel electrode 35, based on the acquired parameters.

In addition, in the display section-driving step ST14, the control circuit 70 inputs the set drive waveform into the pixel electrode 35 by driving the display rewriting circuit 73. As a result, the electrophoretic element 32 is driven according to the difference in potential between the pixel electrode 35 and the common electrode 37, so that an image is displayed on the display section 5.

Below, with reference to FIGS. 6, 7A, 7B, 8A, and 8B, a description will be given of the drive waveform set in the drive waveform-setting step ST13 and of processing in the display section-driving step ST14 based on the corresponding drive waveform.

FIG. 6 is an explanatory view showing the transition of the display state of two pixels 40A and 40B, which will be described below. FIGS. 7A, 7B, 8A, and 8B are views showing a plurality of examples of drive waveforms, which are set in the drive waveform-setting step ST13.

The drive waveforms shown in FIGS. 7A, 7B, 8A, and 8B are drive waveforms, which are input into a pixel electrode 35A (of a pixel 40A) and a pixel electrode 35B (of a pixel 40B) when a white-displayed pixel 40A and a black-displayed pixel 40B, as shown in FIG. 6, are switched into black display and white display, respectively. In addition, FIGS. 7A, 7B, 8A, and 8B show drive waveforms, which are set when environmental temperatures are −5° C., 70° C., and 110° C., respectively.

In the driving method of this embodiment, in the display section-driving step ST14, the potential Vcom of the common electrode 37 is fixed to 0 V. In addition, the pixel 40A and the pixel 40B are displayed black and white, respectively, by applying a plus potential 15 V to the pixel electrode 35A of the pixel 40A to be displayed black and a minus potential −15 V to the pixel electrode 35B of the pixel 40B to be displayed white.

In addition, specific numerical values (e.g., the pulse height 15 V or −15 V or the pulse width 50 ns or 200 ns) applied to the drive waveforms in FIGS. 7A, 7B, 8A, and 8B are merely given for the purpose of easy understanding of the invention, but do not limit the technical range of the invention.

First, the drive waveform shown in FIG. 7A is a drive waveform that is set based on parameters acquired from the LUT 71*a* of Configuration 1 above.

In the display section-driving step ST14, if the environmental temperature in FIG. 7A is −5° C., the number of pulses input into the pixel electrode 35A of the pixel 40A is 5, and the number of pulses input into the pixel electrode 35B of the pixel 40B is 5 as well. The width and height of pulses input into the pixel electrode 35A are the same as those of pulses input into the pixel electrode 35B.

In contrast, under the condition where the environmental temperature is 70° C., the number of pulses input into the pixel electrode 35A is 4, whereas the number of pulses input into the pixel electrode 35B is 5. Under the condition where the environmental temperature is 110° C., the number of pulses input into the pixel electrode 35A is 3, whereas the number of pulses input into the pixel electrode 35B is 5.

In the example shown in FIG. 7A, the number of pulses input into the pixel electrode 35A is reduced as the environmental temperature rises. This can reduce effective electric power input into the electrophoretic element 32 of the pixel 40A. Accordingly, it is possible to control the leak power (=leak current×voltage application time) of the pixel 40A so as to reduce with the rise in environmental temperature. Meanwhile, since the drive waveform input into the pixel electrode 35B does not vary, the tendency of the leak power of the pixel electrode 40B is not changed.

Figure 9:
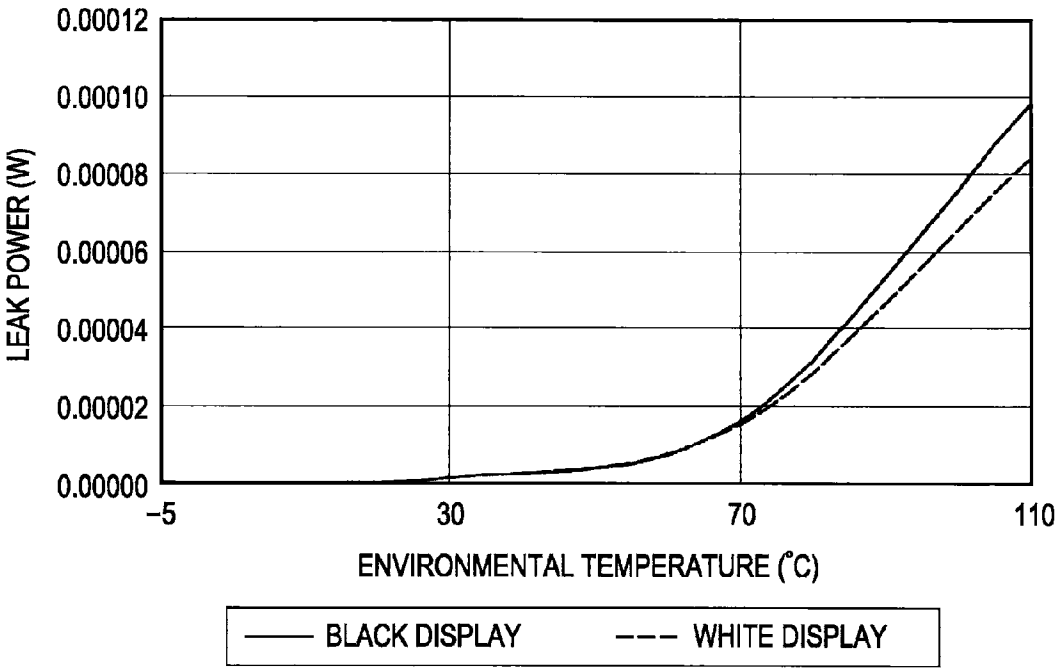
FIG. 9 (Prior Art)
FIG. 9 is a graph showing the relationship between environmental temperature and leak power.
Figure 10A:
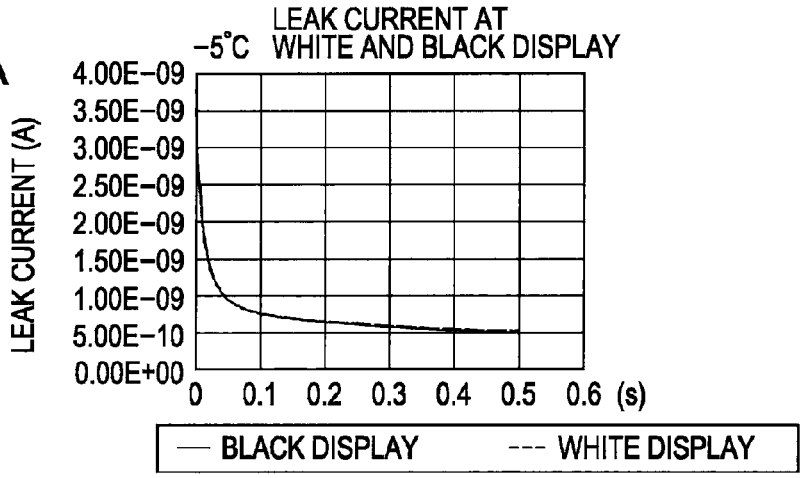
FIG. 10A (Prior Art)
FIGS. 10A to 10C are graphs showing the values of leak currents according to environmental temperatures.
Figure 10B:
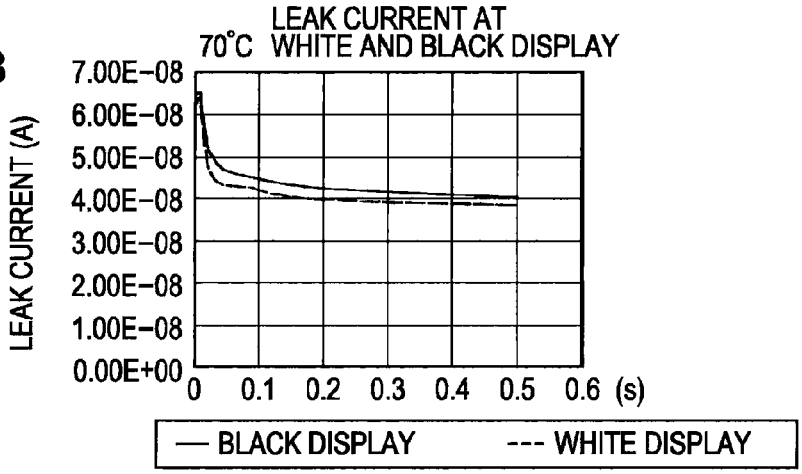
FIG. 10B (Prior Art)
Figure 10C:
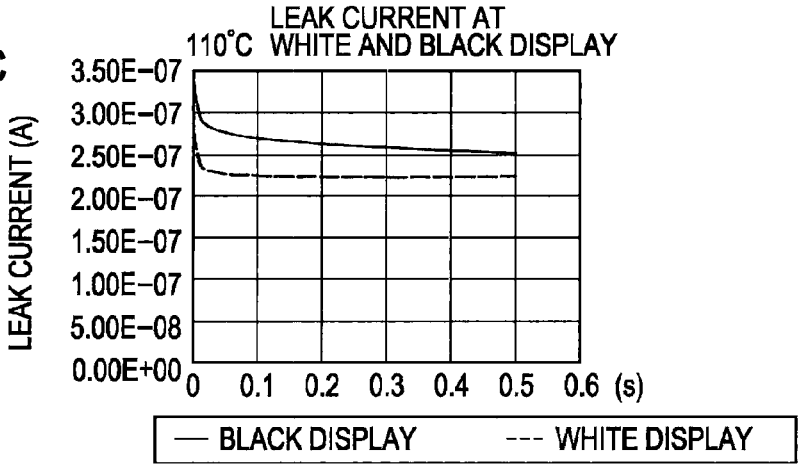
FIG. 10C (Prior Art)

In the graph shown in FIG. 9, the difference between the leak power of black display and the leak power of white display is increasing with the environmental temperature rising. However, the driving method of this embodiment makes it possible relatively to reduce the leak power of black display so as to be similar to the leak power of white display. As a result, according to the driving method of this embodiment, it is possible to prevent the common electrode 37 from degrading by maintaining current balance even in a high-temperature environment.

The relationship between the environmental temperature and the leak power shown in FIG. 9 shows substantially the same tendency in every electrophoretic display device 100. Accordingly, it is possible to control the leak power of black display and the leak power of white display to be substantially the same according to the environmental temperature by acquiring the relationship between the environmental temperature and the leak power in advance and constructing the LUT 71*a* based on that relationship.

In general, the electrophoretic display device adjusts the number of pulses and pulse height in order to compensate for a variation in characteristics of the electrophoretic element 32 or the adhesive layer 33, caused by a change in the environmental temperature. For example, since the electrophoretic particle has low mobility in a low-temperature environment, the number of pulses is increased or the pulse height is raised when compared to that in the high-temperature environment. In this embodiment, for the sake of brevity, the drive waveform is changed only for the purpose of adjusting leak power but is not adjusted for the purpose of compensating for the temperature dependency of the above-described displaying operation. In practice, the driving method first performs the adjustment to compensate for the temperature dependency of the displaying operation, and then sets the drive waveform according to this embodiment.

Figure 7B:
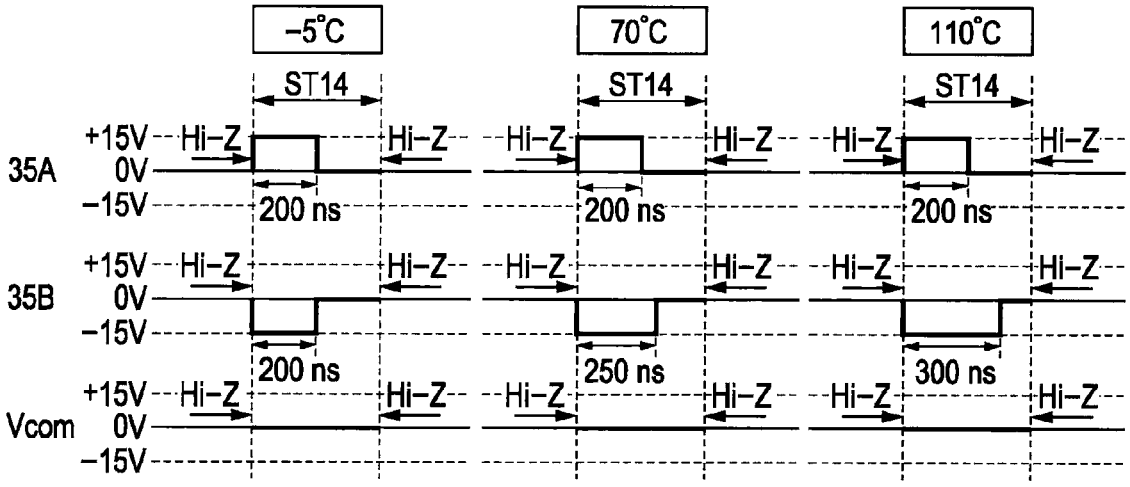

Next, the drive waveform shown in FIG. 7B is a drive waveform set based on parameters acquired from the LUT 71*a* of Configuration 2 above.

In the display section-driving step ST14, if the environmental temperature of FIG. 7B is −5° C., a single pulse is input into the pixel electrode 35A of the black-displayed pixel 40A, with a pulse width 200 ns. In addition, also a single pulse is input into the pixel electrode 35B of the white-displayed pixel 40B, with a pulse width 200 ns. The pulse height input into the pixel electrode 35A is the same as that input into the pixel electrode 35B regardless of the environmental temperature.

In contrast, under the condition where the environmental temperature is 70° C., the pulse width input into the pixel electrode 35A is maintained 200 ns, whereas the pulse width input into the pixel electrode 35B is increased up to 250 ns. Under the condition where the environmental temperature is 110° C., the pulse width input into the pixel electrode 35A is maintained 200 ns, whereas the pulse width input into the pixel electrode 35B is further increased up to 300 ns.

In the example shown in FIG. 7B, the pulse width input into the pixel electrode 35B is increased as the environmental temperature rising. This can increase effective electric power input into the electrophoretic element 32 of the pixel 40A. Accordingly, it is possible to control the leak power of the pixel 40B so as to increase with the environmental temperature rising. Meanwhile, since the drive waveform input into the pixel electrode 35A does not vary, the tendency of the leak power of the pixel electrode 40A is not changed.

In the graph shown in FIG. 9, the difference between the leak power of black display and the leak power of white display is increasing with the environmental temperature rising. However, the driving method of this embodiment makes it possible relatively to increase the leak power of white display so as to be similar to that of black display. As a result, it is possible to prevent the common electrode 37 from degrading by maintaining current balance even in a high-temperature environment.

Figure 8A:
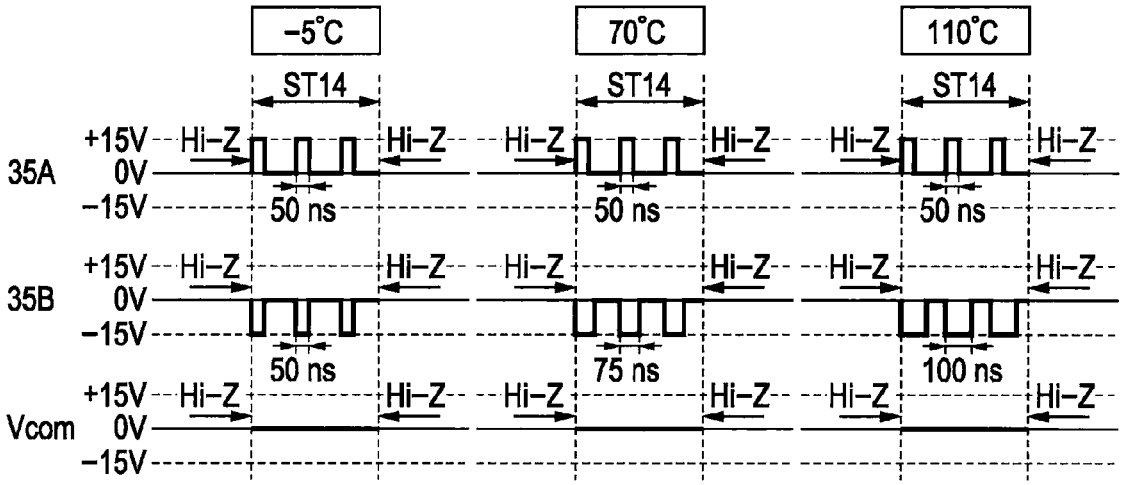
FIGS. 8A and 8B are views showing examples of drive waveforms.

Next, the waveform shown in FIG. 8A is a drive waveform set based on parameters acquired from the LUT 71*a* of Configuration 3 above.

In the display section-driving step ST14, if the environmental temperature in FIG. 8A is −5° C., the number of pulses input into the pixel electrode 35A of the black-displayed pixel 40A is 3, the pulse width is 50 ns, and all of the pulses have the same pulse height 15 V. In addition, the number of pulses input into the pulse electrode 35B of the white-displayed pixel 40B is also 3, and all of the pulses have the same pulse width 50 ns and the same pulse height 15 V.

In contrast, under the condition where the environmental temperature is 70° C., the drive waveform input into the pixel electrode 35A is the same as that in the condition of −5° C., whereas the pulse width of the pulse input into the pixel electrode 35B is 75 ns. That is, the duty ratio is increasing. Under the condition where the environmental temperature is 110° C., the drive waveform input into the pixel electrode 35A is the same as that in the condition of −5° C., whereas the pulse width of the pulse input into the pixel electrode 35B is 100 ns. That is, the duty ratio is further increasing.

In the example shown in FIG. 8A, the duty ratio of the pulses input into the pixel electrode 35B is increased as the environmental temperature rises. This can increase effective electric power input into the electrophoretic element 32 of the pixel 40B. Accordingly, it is possible to control the leak power of the pixel 40B so as to increase with the rise in environmental temperature. Meanwhile, since the drive waveform input into the pixel electrode 35A does not vary, the tendency of the leak power of the pixel electrode 40A is not changed.

In the graph shown in FIG. 9, the difference between the leak power of black display and the leak power of white display is increasing with the rise in environmental temperature. However, the driving method of this embodiment makes it possible relatively to increase the leak power of white display so as to be similar to that of black display. As a result, it is possible to prevent the common electrode 37 from degrading by maintaining current balance even in a high-temperature environment.

Figure 8B:
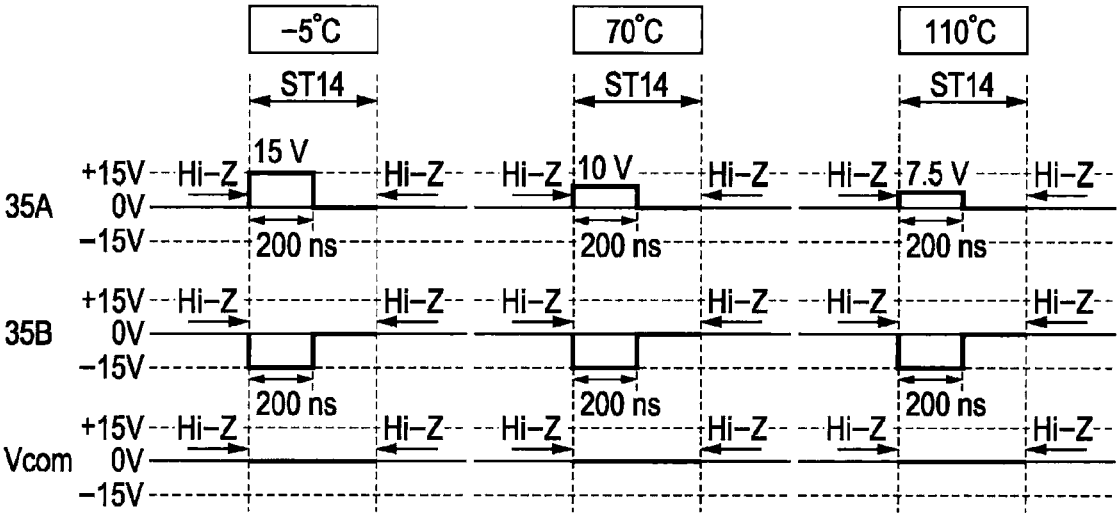

Next, the drive waveform shown in FIG. 8B is a drive waveform that is set based on parameters acquired from the LUT 71*a* of Configuration 4 above.

In the display section-driving step ST14, if the environmental temperature of FIG. 8B is −5° C., a single pulse is input into the pixel electrode 35A of the black-displayed pixel 40A, with a pulse width 200 ns and a pulse height 15 V. In addition, a single pulse is also input into the pixel electrode 35B of the white-displayed pixel 40B, with a pulse width 200 ns and a pulse height 15 V.

In contrast, under the condition where the environmental temperature is 70° C., the pulse width of the pulse input into the pixel electrode 35A is the same as 200 ns, whereas the pulse height is 10 V. Meanwhile, the pulse width (200 ns) and the pulse height (15 V) of the pulse input into the pixel electrode 35B are the same as those under the condition of −5° C. Under the condition where the environmental temperature is 110° C., the pulse height of the pulse input into the pixel electrode 35A is further reduced to 7.5 V, whereas the pulse width (200 ns) and the pulse height (15 V) of the pulse input into the pixel electrode 35B are the same as those under the condition of −5° C.

In the example shown in FIG. 8A, the height of pulses input into the pixel electrode 35A is reduced as the environmental temperature rises. This can reduce effective electric power input into the electrophoretic element 32 of the pixel 40A. Accordingly, it is possible to control the leak power of the pixel 40A so as to reduce with the environmental temperature rising. Meanwhile, since the drive waveform input into the pixel electrode 35B does not vary, the tendency of the leak power of the pixel electrode 40B is not changed.

In the graph shown in FIG. 9, the difference between the leak power of black display and the leak power of white display is increasing with the rise in environmental temperature. However, the driving method of this embodiment makes it possible relatively to reduce the leak power of black display so as to be similar to that of white display. As a result, it is possible to prevent the common electrode 37 from degrading by maintaining current balance even in a high-temperature environment.

As described in detail hereinbefore, the method for driving the electrophoretic display device of this embodiment detects a variation in environmental temperature and sets a drive waveform, which is input into the pixel electrode 35 in black display, and a drive waveform, which is input into the pixel electrode 35 in white display, based on the detected environmental temperature and set or corrected values specified in the LUT 71*a*. Since the above-described driving method is employed, it is possible to compensate for the difference between leak powers in the high-temperature environment shown in FIG. 9. As a result, it is possible effectively to prevent the electrodes from degrading by properly maintaining current balance even if the environmental temperature changes.

Modified Example 1

Although the foregoing embodiment has been described with respect to the configuration that maintains the setting information of the drive waveform in the LUT 71*a*, the configuration can, of course, be provided with a calculator (i.e., a calculating circuit) calculating the same setting information by operation to substitute the LUT 71*a*. The method for calculating the setting information of the drive waveform using an operation formula can adjust the drive waveform with higher precision, thereby further reducing the difference between the leak power of black display and the leak power of white display.

Modified Example 2

The foregoing embodiment has been described with respect to the configuration that sets a drive waveform based on setting information acquired by referring to the LUT 71*a*, based on an environment temperature detected by the temperature sensor 65. However, it is also possible to employ the configuration, as shown in FIG. 4. This configuration is provided with the current detector 75, which detects a current flowing through the display section 5 during a displaying operation. This configuration can detect the value of a leak current varying with a change in environmental temperature based on the current detector 75, and then adjust a drive waveform based on the detected value of the leak current. The current detector 75 is connected to the display section 5 and the control circuit 70 and detects a current flowing between the pixel electrode 35 and the common electrode 37 over the entire or partial area of the display section 5.

In this case, the setting information of drive waveforms, which is for setting the value of the leak current of black display and the value of the leak current of white display so as to be the same, is specified in the LUT 71*a*. It is also possible to control the value of the leak currents of white display and black display so as to be the same by adjusting a driving voltage or a voltage application time while feeding back the values of the leak currents.

Modified Example 3

Although the driving method of the foregoing embodiment is to adjust a drive waveform in response to a change in environmental temperature, it is possible to set the drive waveform of black display and the drive waveform of white display to be always different from each other. For example, the drive waveform of black display is always set to the condition of the environmental temperature 70° C. shown in FIG. 7A (4 pulses), and the drive waveform of white display is always set to the condition of the environmental temperature 70° C. shown in FIG. 7B (5 pulses). Likewise, the configuration shown in FIGS. 7B, 8A, and 8B can be employed.

According to the above-described driving method, the leak power of black display is lowered independently of environmental temperature. Thus, in the vicinity of 70° C. shown in FIG. 9, the leak power of black display and the leak power of white display can be set to be substantially the same even if environmental temperature is not monitored. Accordingly, if the temperature of an application environment can be estimated in advance, it is possible to construct a high-reliability electrophoretic display device having a simple configuration.

However, if the drive waveform is fixed, the difference between leak powers may not be reduced and the electrode may degrade at some environmental temperatures. Accordingly, if the drive waveform is fixed as in this embodiment, it is possible to set the drive waveform so that the leak power of white display is greater than that of black display.

In the graph shown in FIG. 9, since the leak power of black display is increasing, more currents flow into the common electrode 37 from the pixel electrode 35. Under this current condition, a transparent conductive material such as ITO of the common electrode 37 is vulnerable to degradation due to reduction. In this case, it is possible to suppress the reduction of the common electrode 37 by setting the drive waveform so that the leak power of white display increases as described above, thereby preventing the common electrode 37 from degrading.

Below, modified example 3 will be described more fully with reference to FIGS. 14 to 16.

Figure 14:
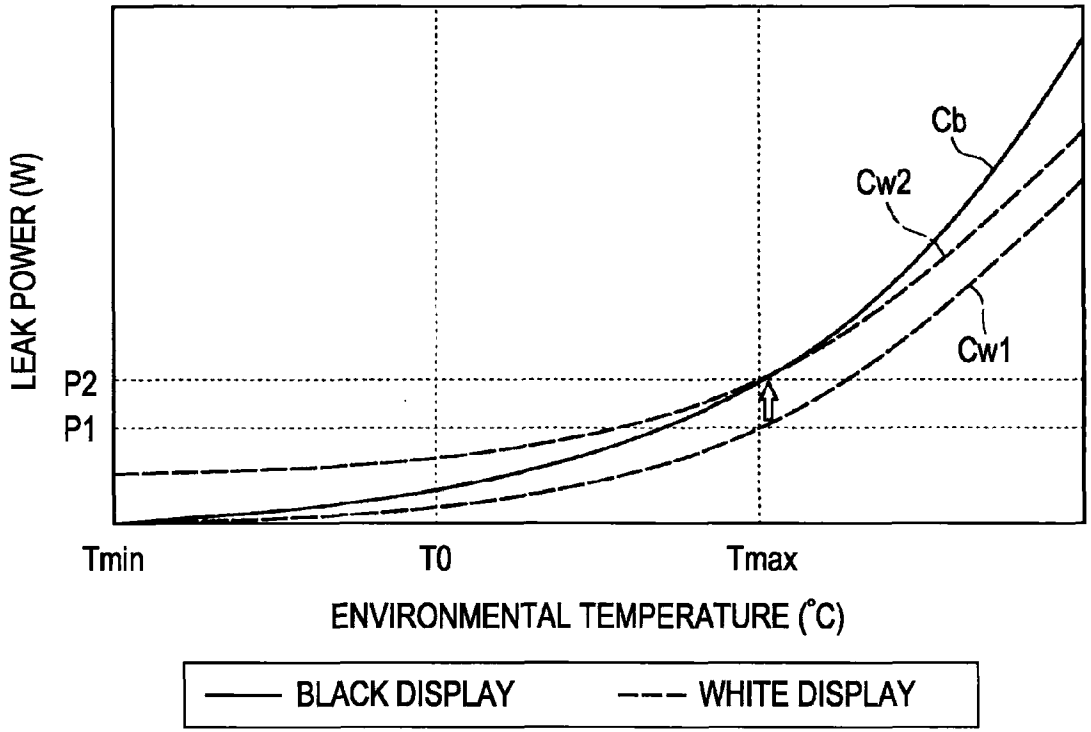
FIG. 14 is an explanatory view showing the relationship between environmental temperature and leak power.

FIG. 14 is an explanatory view showing the relationship between the leak power of white display and environmental temperature and between the leak power of black display of environmental temperature when the driving method of this modified example is applied. FIGS. 15A to 15D are views showing a plurality of profiles of input waveforms in the driving method of this modified example. FIG. 16 is an explanatory view showing the relationship between environmental temperature and the input power of white display and between environmental temperature and the input power of black display when the driving method of this modified example is applied.

As shown in FIG. 14, in the electrophoretic display device, a variation in the leak power of white display (a curve Cw1) with respect to a change in environmental temperature is different from that of black display (i.e., a curve Cb) with respect to the change in environmental temperature. If the input power is the same, the leak power of black display is greater than that of white display as the environmental temperature rises. In addition, in FIG. 14, the difference between the curve Cb and the curve Cw1 is exaggerated for the sake of explanation.

In addition, if the leak power of black display is relatively greater as shown in FIG. 14, the common electrode 37 is vulnerable to degradation. Accordingly, in the driving method of this modified example, as shown in FIG. 14, input power into the electrophoretic element 32 is adjusted so that the leak power of white display exceeds that of black display in a preset temperature range Tmin to Tmax. Specifically, the input power is changed in such a manner that the characteristics of the leak power of white display are moved from the curve Cw1 to a curve Cw2, thereby ensuring the leak power of white display to always exceed that of black display in a temperature range equal to or lower than the upper limit temperature Tmax.

The upper limit temperature Tmax is the upper limit of the range of environmental temperature, which is determined according to the application of the electrophoretic display device. For example, Tmax is set in the range from 80° C. to 125° C. in an electrophoretic display device, which is used for a vehicle-mounted application. In addition, Tmax is set in the range from 60° C. to 80° C. for an application of an electronic paper, which is used in a display section of an electronic device.

In addition, as shown in FIG. 14, the input power of the electrophoretic element 32 is adjusted by calculating the adjustment factor k of the leak power of white display. The adjustment factor k is calculated using the ratio (P2/P1) of the leak power of white display P1 (i.e., the curve Cw1) to the leak power of black display P2 (i.e., the curve Cb) at the preset upper limit temperature Tmax.

The adjustment of the input power can be performed, as in the foregoing embodiment, based on the number of pulses input into the electrode, pulse width, duty ratio, pulse height, and a combination thereof.

Figure 15A:
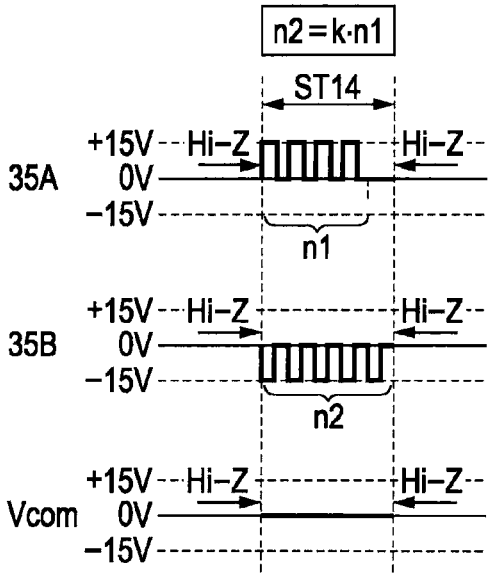
FIGS. 15A to 15D are views showing a plurality of profiles of input waveforms according to modified example 3.

FIG. 15A is a view showing the case where the input waveform of the pixel electrode 35A and the input waveform of the pixel electrode 35B are set differently from each other according to the number of pulses. According to this configuration, in the display section-driving step ST14, the number of pulses n1 input into the pixel electrode 35A and the number of pulses n2 input into the pixel electrode 35B are set so as to satisfy the relationship: $n2=k \cdot n1$, based on the factor k calculated from leak power. In addition, the waveforms input into the pixel electrodes 35A and 35B have the same pulse width, duty ratio, and pulse height.

Figure 15B:
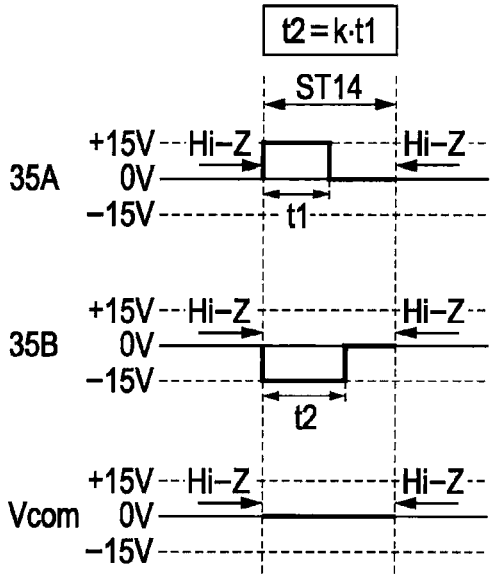

FIG. 15B is a view showing the case where the input waveform of the pixel electrode 35A and the input waveform of the pixel electrode 35B are set differently from each other according to the pulse width. According to this configuration, in the display section-driving step ST14, the pulse width t1 input into the pixel electrode 35A and the pulse width t2 input into the pixel electrode 35B are set so as to satisfy the relationship: $t2=k \cdot t1$, based on the factor k calculated from leak power. In addition, the waveforms input into the pixel electrodes 35A and 35B have the same number of pulses, duty ratio, and pulse height.

Figure 15C:
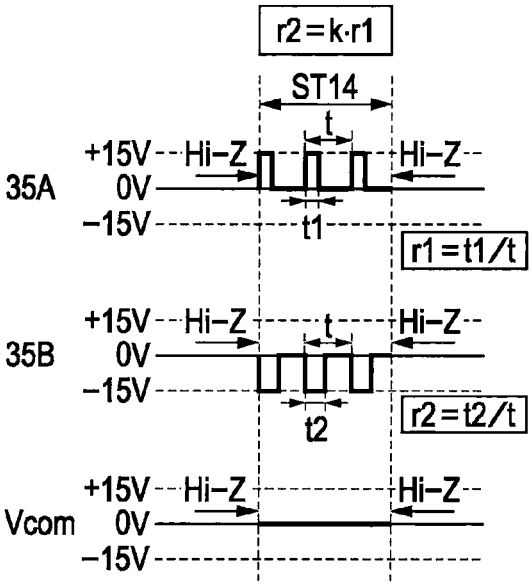

FIG. 15C is a view showing the case where the input waveform of the pixel electrode 35A and the input waveform of the pixel electrode 35B are set differently from each other according to the duty ratio. According to this configuration, in the display section-driving step ST14, the duty ratio r1 (=t1/t) of pulses input into the pixel electrode 35A and the duty ratio r2 (=t2/t) of pulses input into the pixel electrode 35B are set to satisfy the relationship: $r2=k \cdot r1$, based on the factor k calculated from leak power. In addition, the waveforms input into the pixel electrodes 35A and 35B have the same number of pulses, pulse width, and pulse height.

Figure 15D:
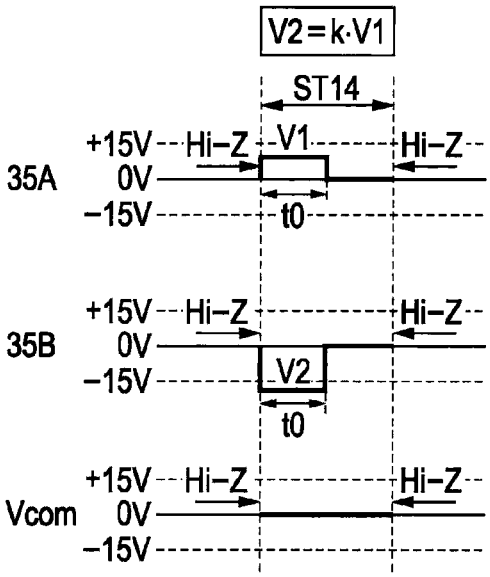

FIG. 15D is a view showing the case where the input waveform of the pixel electrode 35A and the input waveform of the pixel electrode 35B are set differently from each other according to the pulse width. According to this configuration, in the display section-driving step ST14, the pulse height V1 of pulses input into the pixel electrode 35A and the pulse height V2 of pulses input into the pixel electrode 35B are set to satisfy the relationship: $V2=k \cdot V1$, based on the factor k calculated from leak power. In addition, the waveforms input into the pixel electrodes 35A and 35B have the same number of pulses, pulse width, and duty ratio.

In the foregoing embodiment, the ratio of the input power of white display to that of black display is set to vary according to a change in environmental temperature. However, in this modified example, the ratio of the input power of white display to that of black display is independent of environmental temperature but is of a constant value (i.e., factor k). Accordingly, it is not necessary to prepare the input power of white display according to environmental temperature. As shown in FIGS. 15A to 15D, it is possible to acquire the input power of white display by performing an operation on the input waveform of black display. Alternatively, it is possible to store input waveforms, which are calculated in advance from the input waveform of black display, in the LUT 71*a*.

In the electrophoretic display device, the mobility of electrophoretic particles (the black particles 26 and the white particles 27) of the electrophoretic element 32 greatly varies according to environmental temperature. Control is performed to change the input power into the pixel electrode 35 in response to a change in environmental temperature. For example, as shown in FIG. 16, input waveforms (e.g., the number of pulses, pulse width, duty ratio, and pulse height) are adjusted so that input power is reduced as environmental temperature rises. This is because the electrophoretic particles are more movable due to, for example, reduction in the viscosity of the dispersion medium of the electrophoretic element 32 when temperature rises.

In the driving method of this embodiment, the input power of black display and the input power of white display are adjusted so as to be a constant ratio (i.e., factor k), which is calculated based on leak power. Accordingly, as shown in FIG. 16, the input power Pb of black display and the input power Pw of white display are set so as to satisfy the formula: $Pw=k \cdot Pb$.

Figure 16:
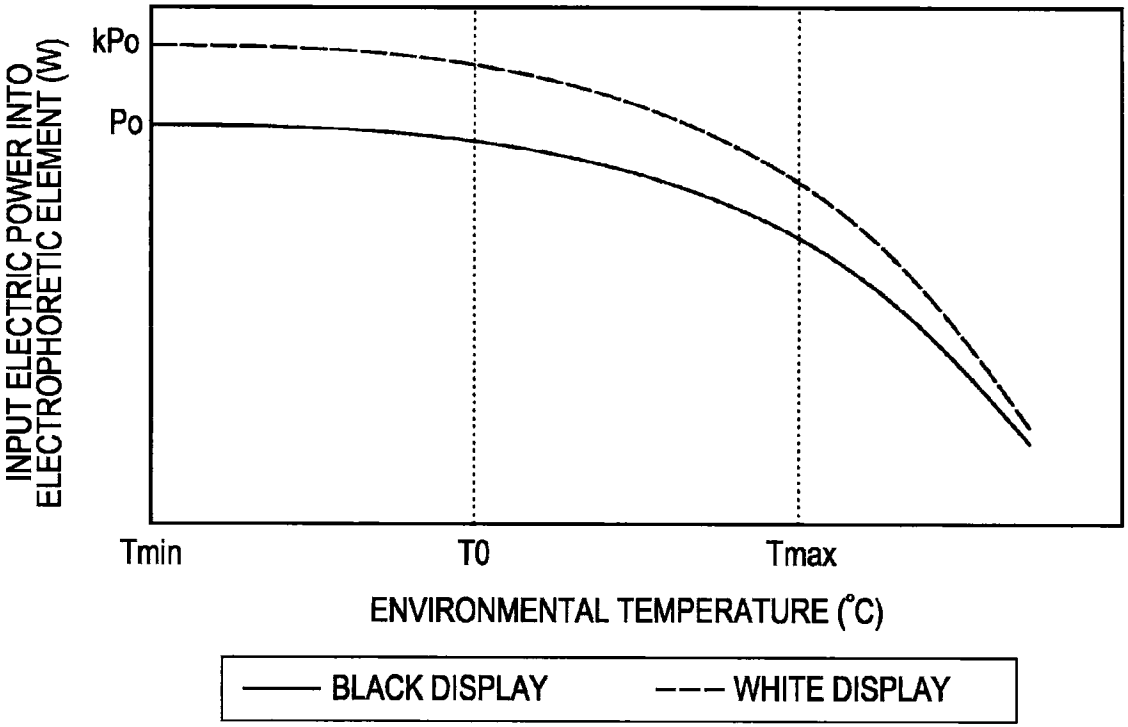
FIG. 16 is a view showing the relationship between environmental temperature and input power.

In the case of black display shown in FIG. 16, the value of its input power is set in advance based on the temperature characteristics of the electrophoretic element 32 and is stored in the LUT 71*a* or the like. Accordingly, when the driving method of this embodiment is performed, the value of the input power of white display can be easily calculated by performing an operation on the value of the input power of black display, stored in the LUT 71*a*, based on the factor k.

According to the driving method of this modified example as described above, the factor k is calculated by combining the leak power of white display and the leak power of black display at the upper limit temperature Tmax, and the input power of black display and the input power of white display are set so as to be preset ratios by the factor k. As a result, as shown in FIG. 14, the leak power of white display can be set to exceed that of black display over the entire range from the lower limit temperature Tmin to the upper limit temperature Tmax. Accordingly, it is possible to prevent reduction that would otherwise degrade the common electrode 37.

In addition, this modified example has an advantage of easy control when compared to the foregoing embodiment in which the ratio of the input power of white display to that of black display is changed according to environmental temperature. This is because, in this modified example, the ratio of the input power of white display to that of black display is set to a constant ratio (i.e., factor k) independently of environmental temperature. In particular, in the electrophoretic display device, since the control of input power for compensating for the temperature characteristics of the electrophoretic element 32 is generally performed, the control is complicated if it is attempted simultaneously to control leak power as in the foregoing embodiment. In contrast, in this modified example, it is possible to manage only the value of the input power of black display as the value of input power for compensating for temperature characteristics since the value of the input power of white display can be calculated by performing an operation on the value of the input power of black power. Accordingly, it is possible to realize simply a driving method having high reliability.

In addition, in the driving method of this modified example, as shown in FIG. 14, writing in white display is strong since the power is input into the electrophoretic element 32 so that the leak power of white display exceeds that of black display. However, since the black particles 26 are significantly visible in the case of burning-in and the writing of black display is weak in this embodiment, burning-in rather rarely occurs.

In addition, if the particle size of the white particles 27 is greater than that of the black particles 26 (i.e., carbon particles), the white particles 27 have relatively low mobility. In contrast, this modified example can improve the mobility of white display by setting the input power of white display to be great so that the white particles 27 are easily movable.

In addition, although the foregoing embodiment was described, by way of an example, with respect to the case where the leak power of black display is greater than that of white display, sometimes the leak power of white display may be greater than that of black display. The relative magnitude between the leak power of black display and the leak power of white display is determined by a variety of factors including the material, particle size, mass, and charge of the black and white particles 26 and 27; the characteristics and temperature of the dispersion medium; and the like. Due to these factors, one of the leak power of black display and the leak power of white display is set greater than the other. Under the condition where the leak power of white display is relatively greater, the leak power of white display can be relatively reduced so as to be similar to that of black display by adjusting one or more of the driving voltage and the voltage application time. According to a specific aspect of the invention, some factors such as the driving voltage (latitude), the application time (pulse width), and the number of pulses can be changed between white display and black display.

In addition, a majority of the electrophoretic display devices that use an easily-reducing material such as ITO or the like for one of the electrodes disposed on both sides of an electrophoretic element may encounter the problem in which the electrode is reduced due to the broken balance between the leak power of white display (light display) and the leak power of black display (dark display). Accordingly, the configuration of the electrophoretic display device is not limited to that as disclosed in the foregoing embodiments in which the black and white particles 26 and 27 are dispersed in the microcapsules 20. Rather, the electrophoretic display device may have a variety of configurations. For example, the electrophoretic particles can be dispersed in areas divided by partitions.

Furthermore, the foregoing embodiments have been described with respect to the segment type electrophoretic display device. It is, of course, possible to realize the same operational effects even if the invention is applied to an active matrix type electrophoretic display device.

Electronic Device

Below, a description will be given of an electronic device to which the electrophoretic display device 100 according to any one of the foregoing embodiments is applied.

Figure 11:
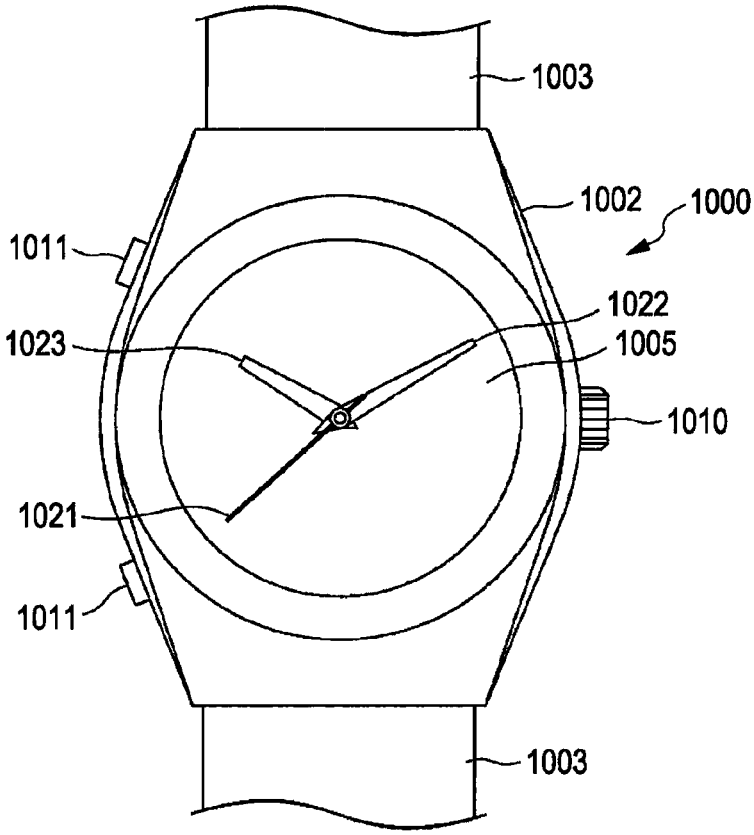
FIG. 11 is a view showing an example of an electronic device.

FIG. 11 is a front elevation view of a wristwatch 1000. The wristwatch 1000 includes a watch case 1002 and a pair of bands 1003 connected to the watch case 1002.

In the front portion of the watch case 1002, a display section 1005, which is embodied by the electrophoretic display device 100 of the foregoing embodiment, a second hand 1021, a minute hand 1022, and an hour hand 1023 are provided. On the side portion of the watch case 1002, a stem 1010 functioning as a manipulator and an operation button 1011 are provided. The stem 1010 is connected to a winder provided inside the case and can be pulled and rotated in multiple stages (e.g., two stages) as a unitary body with the winder. On the display section 1005, a background image, a series of letters such as date and time, a second hand, a minute hand, an hour hand, or the like can be displayed.

Figure 12:
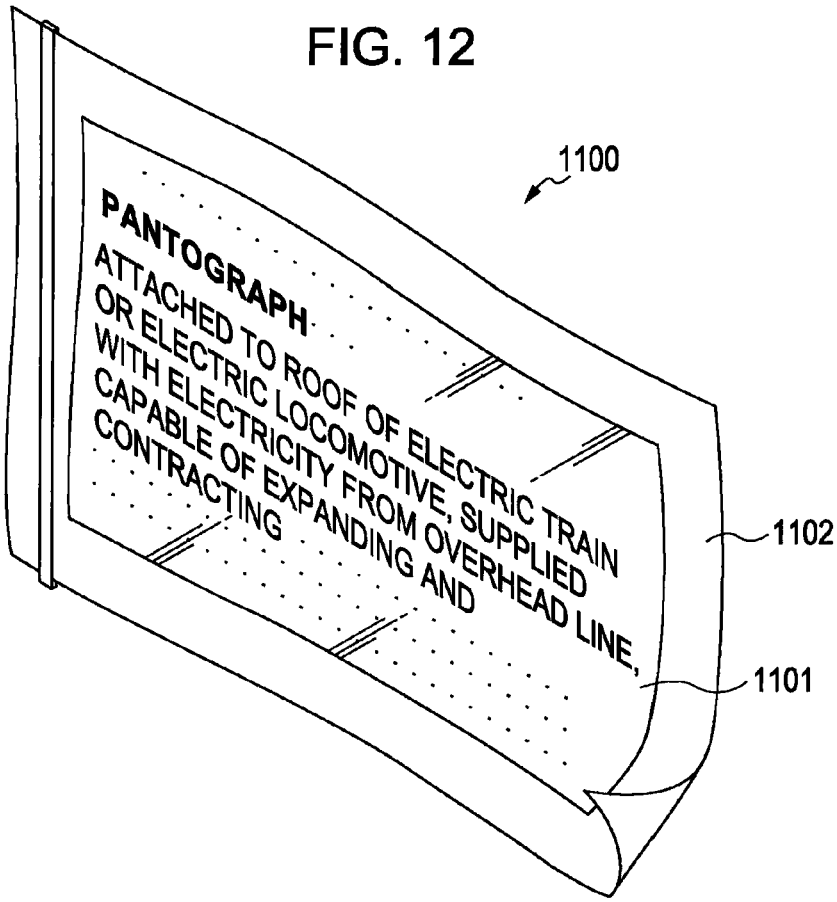
FIG. 12 is a view showing an example of an electronic device.

FIG. 12 is a perspective view showing the configuration of an electronic paper 1100. The electronic paper 1100 has the electrophoretic display device 100 of the foregoing embodiment in a display area 1101. The electronic paper 1100 has a body 1102 made of a rewritable sheet, the flexibility of which ensures texture and softness similar to those of conventional paper.

Figure 13:
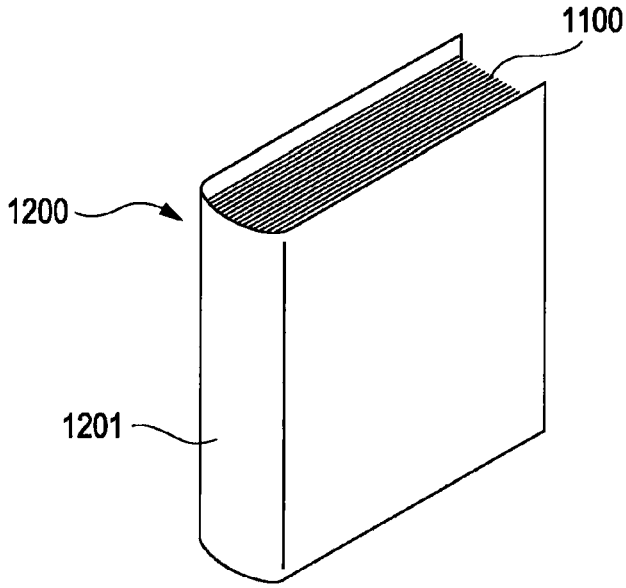
FIG. 13 is a view showing an example of an electronic device.

FIG. 13 is a perspective view showing the configuration of an electronic notebook 1200. The electronic notebook 1200 has a plurality of electronic papers 1100, which are bound together and surrounded by a cover 1201. The cover 1201 has a display data input section (not shown) into which display data sent from, for example, an external device is input. This makes it possible to change or update the display contents according to the display data in the state where the electronic papers are bound.

The wristwatch 1000, the electronic paper 1100, and the electronic notebook 1200 as described above can form electronic devices having a high-reliability display section since the electrophoretic display device 100 is employed.

In addition, the above-described electronic devices merely illustrate an electronic device according to an exemplary embodiment of the invention but do not limit the technical range of the invention. For example, the electrophoretic display device according to an exemplary embodiment of the invention can be very properly used in a display section of an electronic device such as a mobile phone or a portable audio device.

The entire disclosure of Japanese Patent Application Nos: 2009-026393, filed Feb. 6, 2009 and 2009-180602, filed Aug. 3, 2009 are expressly incorporated by reference herein.

What is claimed is:

1. A method for driving an electrophoretic display device, which includes a first electrode, a second electrode, and an electrophoretic element disposed between the first electrode and the second electrode, the first electrode including first and second pixel electrodes, the method comprising:

first driving the electrophoretic element through the first pixel electrode, which displays a first gradation with minimum reflectivity at a first temperature, by applying a first driving signal pattern for a first unit period with a first driving voltage and a first voltage application time, second driving the electrophoretic element through the second pixel electrode, which displays a second gradation with maximum reflectivity at the first temperature, by applying a second driving signal pattern for the first unit period with a second driving voltage and a second voltage application time, third driving the electrophoretic element through the first pixel electrode, which displays the first gradation at a second temperature, by applying a third driving signal pattern for a second unit period with a third driving voltage and a third voltage application time, and fourth driving the electrophoretic element through the second pixel electrode, which displays the second gradation at the second temperature, by applying a fourth driving signal pattern for the second unit period with a fourth driving voltage and a fourth voltage application time, wherein first through fourth multiplications are multiplications of the first through fourth driving voltages and the first through fourth voltage application times, respectively, the first multiplication is different from the second multiplication, and the first multiplication is different from the third multiplication or the second multiplication is different from the fourth multiplication.

2. The method according to claim 1, wherein first leak power during the first driving of the electrophoretic element through the first pixel electrode for the first unit period and second leak power during the second driving of the electrophoretic element through the second pixel electrode for the first unit period are substantially equal to each other by adjusting the first and second driving signal patterns.

3. The method according to claim 2, wherein the electrophoretic display device includes a plurality of first electrodes including the first and second pixel electrodes facing the second electrode, the second electrode is made of a transparent conductive material, and the electrophoretic element is disposed between the plurality of first electrodes and the second electrode, the method further comprising:

driving the electrophoretic element through the second electrode by applying a fifth driving voltage, wherein one of the first and second leak powers, which is obtained when one of the first and second driving voltages is lower than the fifth driving voltage, is larger than the other of the first and second leak powers, which is obtained when the other of the first and second driving voltages is higher than the fifth driving voltage.

4. The method according to claim 3, wherein first input power, which drives the electrophoretic element and is obtained when the one of the first and second driving voltages is lower than the fifth driving voltage, exceeds second input power, which drives the electrophoretic element and is obtained when the other of the first and second driving voltages is higher than the fifth driving voltage, and the first input power has a constant ratio with respect to the second input power.

5. The method according to claim 4, wherein the constant ratio is set so as to make the one of the first and second leak powers, which is obtained when the one of the first and second driving voltages is lower than the fifth driving voltage, at a predetermined environmental temperature equal to the other of the first and second leak powers, which is obtained when the other of the first and second driving voltages is higher than the fifth driving voltage at the predetermined environmental temperature.

6. The method according to claim 5, wherein the first and second leak powers are set in an application temperature range of the electrophoretic display device.

7. The method according to claim 1, wherein the first and second driving voltages and the first and second voltage application times are set based on environmental temperature.

8. The method according to claim 1, wherein the first and second driving voltages and the first and second voltage application times are set based on a leak current value between the first electrode and the second electrode.

9. The method for driving an electrophoretic display device according to claim 1, wherein a first ratio of the first multiplication to the third multiplication is different from a second ratio of the second multiplication to the fourth multiplication.

10. An electrophoretic display device comprising:

a first electrode;

a second electrode; and an electrophoretic element disposed between the first electrode and the second electrode, wherein the first electrode includes first and second pixel electrodes, the electrophoretic element is driven through the first pixel electrode, which displays a first gradation with minimum reflectivity at a first temperature, by applying a first driving signal pattern for a first unit period with a first driving voltage and a first voltage application time, the electrophoretic element is driven through the second pixel electrode, which displays a second gradation with maximum reflectivity at the first temperature, by applying a second driving signal pattern for the first unit period with a second driving voltage and a second voltage application time, the electrophoretic element is driven through the first pixel electrode, which displays the first gradation at a second temperature, by applying a third driving signal pattern for a second unit period with a third driving voltage and a third voltage application time, the electrophoretic element is driven through the second pixel electrode, which displays the second gradation at the second temperature, by applying a fourth driving signal pattern for the second unit period with a fourth driving voltage and a fourth voltage application time, first through fourth multiplications are multiplications of the first through fourth driving voltages and the first through fourth voltage application times, respectively, the first multiplication is different from the second multiplication, and the first multiplication is different from the third multiplication or the second multiplication is different from the fourth multiplication.

11. The electrophoretic display device according to claim 10, further comprising a controller adjusting first leak power during the driving of the electrophoretic element through the first pixel electrode for the first unit period and second leak power during the driving of the electrophoretic element through the second pixel electrode for the first unit period so as to be substantially equal to each other by adjusting the first and second driving signal patterns.

12. The electrophoretic display device according to claim 11, further comprising a plurality of first electrodes including the first and second pixel electrodes, the plurality of first electrodes facing the second electrode, wherein the second electrode is made of a transparent conductive material, the electrophoretic element is disposed between the plurality of first electrodes and the second electrode, the electrophoretic element is driven through the second electrode by applying a fifth driving voltage, and one of the first and second leak powers, which is obtained when one of the first and second driving voltages is lower than the fifth driving voltage, is larger than the other of the first and second leak powers, which is obtained when the other of the first and second driving voltages is higher than the fifth driving voltage.

13. The electrophoretic display device according to claim 10, further comprising:

a temperature detector detecting environmental temperature; and a calculator or a table that relates to at least one of the first and second driving voltage and the first and second voltage application times to the environmental temperature.

14. The electrophoretic display device according to claim 10, further comprising:

a current measurer measuring a value of a leak current flowing between the first and second electrodes; and a calculator or a table that relates to at least one of the first and second driving voltage and the first and second voltage application times to the value of the leak current.

15. An electronic device comprising the electrophoretic display according to claim 10.

16. The electrophoretic display device according to claim 10, wherein a first ratio of the first multiplication to the third multiplication is different from a second ratio of the second multiplication to the fourth multiplication.

* * * * *